US006795668B1

(12) United States Patent
Nishiwaki

(10) Patent No.: US 6,795,668 B1
(45) Date of Patent: Sep. 21, 2004

(54) DEGRADED TONER DISCHARGING AND NEW TONER REPLENISHING MECHANISM OPERABLE WHEN FOG IS DETECTED

(75) Inventor: Kenjiro Nishiwaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/614,202

(22) Filed: Jul. 8, 2003

(30) Foreign Application Priority Data

Jul. 8, 2002 (JP) ..... 2002-199106

(51) Int. Cl.[7] ..... G03G 15/08

(52) U.S. Cl. ..... 399/120; 399/35; 399/99; 399/256; 399/360

(58) Field of Search ..... 347/158; 399/34, 399/35, 99, 120, 256, 360

(56) References Cited

U.S. PATENT DOCUMENTS 5,293,201 A * 3/1994 Kamp et al. ..... 399/356
5,436,703 A * 7/1995 DeYoung et al. ..... 355/45
5,909,609 A * 6/1999 Yahata et al. ..... 399/102
5,946,523 A * 8/1999 Fujioka et al. ..... 399/49
6,167,211 A * 12/2000 Oogi et al. ..... 399/53
6,298,217 B1 * 10/2001 Murayama et al. ..... 399/360
6,339,689 B1 * 1/2002 Sugiura ..... 399/120
6,353,722 B1 * 3/2002 Klimley et al. ..... 399/257
6,418,284 B1 * 7/2002 Mercer ..... 399/120
6,466,763 B1 * 10/2002 Campbell et al. ..... 399/360
6,603,759 B1 * 8/2003 Itoh et al. ..... 399/359
6,640,075 B1 * 10/2003 Weber et al. ..... 399/257
6,721,519 B2 * 4/2004 Brown ..... 399/71
2002/0064395 A1 * 5/2002 Funayama ..... 399/120
2003/0031490 A1 * 2/2003 Takahashi ..... 399/359
2004/0047651 A1 * 3/2004 Koyama ..... 399/120
2004/0067076 A1 * 4/2004 Shinkai ..... 399/258
2004/0076454 A1 * 4/2004 Nishiyama ..... 399/269

FOREIGN PATENT DOCUMENTS

JP A 10-186855 7/1998
JP A 11-119531 4/1999
JP A 11-249418 9/1999

* cited by examiner

*Primary Examiner*—Eugene H. Eickholt
(74) *Attorney, Agent, or Firm*—Oliff & Berridge, PLC

(57) ABSTRACT

When a sensor in an image forming device detects fog on the photosensitive belt, the CPU of the image forming device controls the shutter in each toner hopper unit to open and drives a discharging auger to rotate, causing degraded toner to be discharged from the developing chamber into a waste toner accommodating chamber. After this discharging operation is completed, the CPU closes the shutter and begins driving a supply auger to rotate in order to supply new toner from the accommodating chamber into the developing chamber, thereby replacing most of the old toner in the developing chamber with new toner.

19 Claims, 8 Drawing Sheets

DEGRADED TONER DISCHARGING AND NEW TONER REPLENISHING MECHANISM OPERABLE WHEN FOG IS DETECTED

BACKGROUND OF THE INVENTION

1. Field of the Invention

The present invention relates to an image forming device such as a laser printer. More particularly, the invention relates to a degraded toner discharging and new toner replenishing mechanism operable when fog is detected.

2. Description of the Related Art

Image forming devices, such as laser printers, using toner made from a nonmagnetic, single-component material have conventionally been provided with developer cartridges detachably mounted in the image forming device. The developer cartridge includes an accommodating chamber for accommodating toner and a developing chamber having a developing roller for carrying toner.

This type of developer cartridge is mounted in the image forming device such that the developing roller confronts a photosensitive drum. Toner supplied from the accommodating chamber is carried on the developing roller. The toner is brought into contact with the photosensitive drum to develop an electrostatic latent image formed thereon, creating a toner image. The developed toner image is then transferred onto a sheet of paper by a transfer roller, forming an image on the paper.

However, toner supplied from the accommodating chamber to the developing chamber in this type of developing cartridge gradually deteriorates due to friction and the like generated by the developing roller and a supply roller that supplies toner to this developing roller. Allowing this type of toner to remain in the developing chamber for an extended amount of time can lead to a decline in image quality caused by the generation of fog and the like on the paper.

In view of this problem, Japanese unexamined patent application publication No. HEI-11-119531 proposes a process of supplying new toner from the accommodating chamber while simultaneously discharging degraded toner from the developing chamber. In addition, Japanese unexamined patent application publication No. HEI-10-186855 proposes discharging degraded toner from the developing chamber after supplying new toner from the accommodating chamber.

However, if the developing chamber is replenished with new toner while the degraded toner remains therein, the new toner becomes mixed with the degraded toner, inevitably leading to the generation of fog.

SUMMARY OF THE INVENTION

In view of the foregoing, it is an object of the present invention to provide an image forming device capable of replacing toner currently in use with unused toner without causing the used and unused toners to mix together for a substantial amount.

It is another object of the present invention to provide an image forming device in which image quality is improved by controlling fog.

To achieve the above and other objects, there is provided an image forming device that includes a photosensitive member, a developing chamber, a developing member, an accommodating chamber, a waste toner accommodating chamber, a supply auger, a discharge auger, and controller. The photosensitive member has a surface on which a latent image is formed. The developing member is housed in the developing chamber and develops the latent image with toner. Waste toner that is deteriorated in quality stays in the developing chamber. The accommodating chamber accommodates toner. The waste toner accommodating chamber accommodates waste toner. The supply auger supplies toner from the accommodating chamber to the developing chamber. The discharge auger discharges toner from the developing chamber into the waste toner accommodating chamber. The controller controls the supply auger and the discharge auger, wherein the controller executes a toner replacing process for driving the discharge auger to discharge waste toner from the developing chamber and for subsequently driving the supply auger to supply toner from the accommodating chamber to the developing chamber.

With this construction, when the controller executes the toner replacing process, the controller first drives the discharge auger to discharge toner that is currently in use from the developing chamber to the waste developer accommodating chamber. After this discharging operation has completed, the controller drives the supply auger to supply unused toner from the accommodating chamber to the developing chamber. Hence, the toner replacing process replaces toner currently in use in the developing chamber with unused toner such that almost none of the used toner is mixed with the unused toner. As a result, it is possible to improve image quality by replacing used toner with unused toner.

It is desirable to use a deterioration detector that detects deterioration in quality of toner. In this case, the controller executes the toner replacing process when the deterioration detector detects the deterioration of toner.

With this construction, the controller executes the toner replacing process based on the deterioration of the toner. Accordingly, deteriorating toner currently being used in the developing chamber is replaced with new, unused toner. Thereby, maintaining good image quality by replacing toner at a precise timing.

BRIEF DESCRIPTION OF THE DRAWINGS

In the drawings:

FIG. 4(*b*) is a side cross-sectional view showing the developing unit of the color laser printer of FIG. 1 wherein the shutter exposes the discharge auger to the developing chamber;

DESCRIPTION OF THE PREFERRED EMBODIMENTS

An image forming device according to a preferred embodiment of the present invention will be described while referring to the accompanying drawings.

Figure 1:
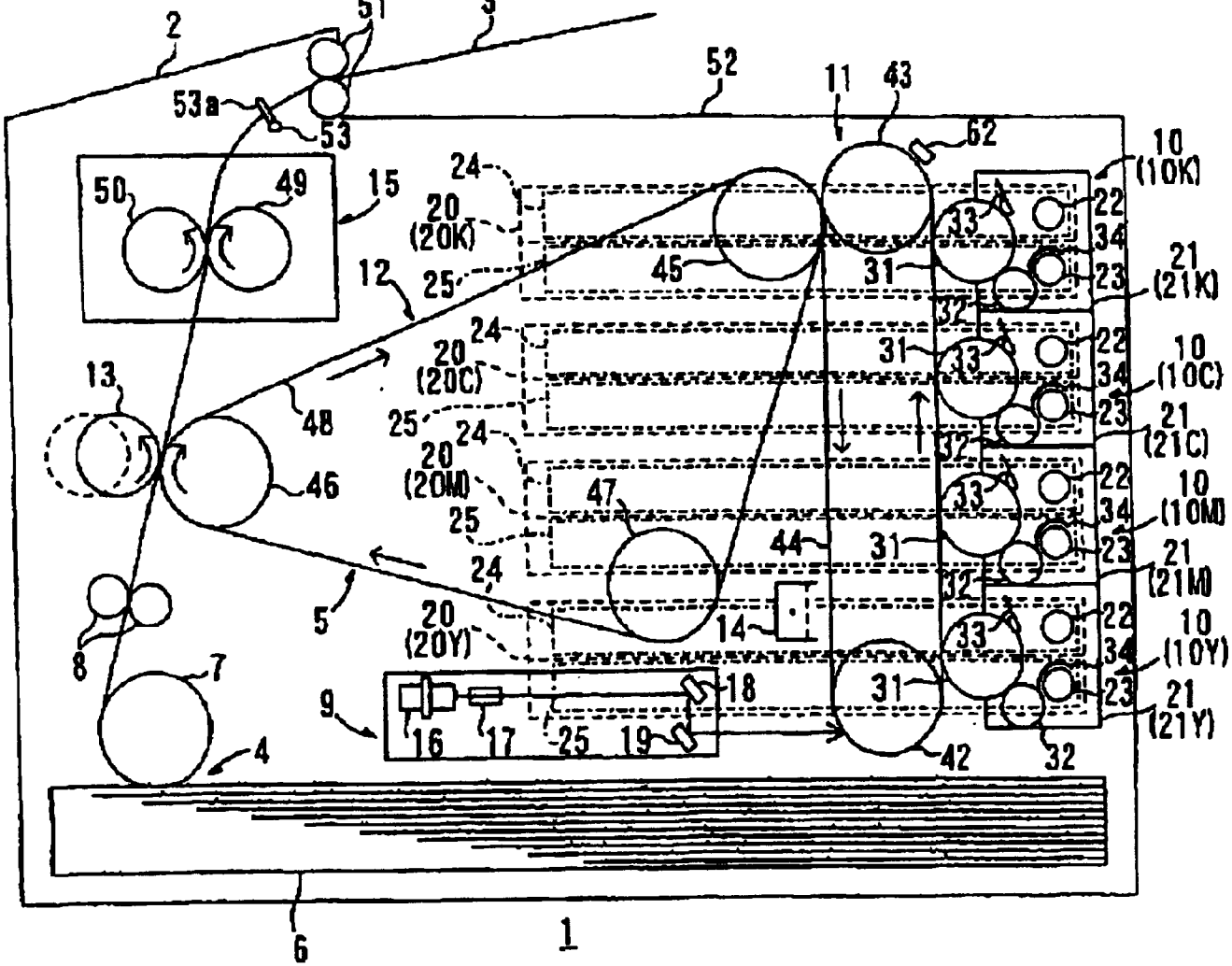
FIG. 1 is a side cross-sectional view showing the relevant parts of a color laser printer according to a preferred embodiment of the present invention.

FIG. 1 is a side cross-sectional view showing the relevant parts of a color laser printer according to a preferred embodiment, serving as the image forming device of the present invention. As shown in FIG. 1, a color laser printer 1 includes a main case 2 and, within the main case 2, a feeder unit 4 for feeding sheets of a paper 3 as a recording medium, an image forming unit 5 for forming images on the paper 3 supplied from the feeder unit 4.

The feeder unit 4 includes a paper supply tray 6, a feed roller 7 disposed above one end of the paper supply tray 6 (hereafter the side of the main case 2 in which the feed roller 7 is provided will be referred to as the front side, while the side in which developing units 21 described later are provided will be referred to as the back side), and registration rollers 8 disposed above the feed roller 7.

The feed roller 7 feeds the topmost sheet of paper 3 on the paper supply tray 6 one sheet at a time into the front section of the main case 2. The registration rollers 8 adjust the timing of the sheet of the paper 3 to move toward an image forming position. Here, the image forming position is the point of contact between a transfer roller 13 and a first intermediate transfer member support roller 46, described later.

The image forming unit 5 includes a scanning unit 9, a plurality (four in the present embodiment) of developing units 10, a photosensitive belt mechanism 11, an intermediate transfer belt mechanism 12, the transfer roller 13, a Scorotron charging device 14, a fixing unit 15, and the like.

The scanning unit 9 is positioned above the feeder unit 4 in the main case 2 and below the intermediate transfer belt mechanism 12 and includes a laser-emitting element (not shown), a polygon mirror 16 that is driven to rotate, a lens 17, and reflecting mirrors 18 and 19. In the scanning unit 9, the laser-emitting unit emits a laser beam based on image data. The laser beam passes through or reflects off of the polygon mirror 16, lens 17, and reflecting mirrors 18 and 19 in sequence, as shown by the arrow in the drawing, and is irradiated in a high-speed scanning motion onto the surface of a photosensitive belt 44 in the photosensitive belt mechanism 11 described later.

The four developing units 10 are arranged in the back section of the main case 2, parallel to one another and aligned vertically with a prescribed interval between adjacent units. The developing units 10 include a yellow developing unit 10Y, a magenta developing unit 10M, a cyan developing unit 10C, and a black developing unit 10K for each color of toner serving as the developer.

Each developing unit 10 includes a toner hopper unit 20 for accommodating toner of each color (when differentiating toner hopper units by color, a yellow hopper unit 20Y accommodates yellow toner, a magenta hopper unit 20M accommodates magenta toner, a cyan hopper unit 20C accommodates cyan toner, and a black hopper unit 20K accommodates black toner), the developing unit 21 for developing toner of each color (when distinguishing developing units by color, a yellow developing unit 21Y develops yellow toner, a magenta developing unit 21M develops magenta toner, a cyan developing unit 21C develops cyan toner, and a black developing unit 21K develops black toner), a supply auger 22 for supplying toner from an accommodating chamber 24 described later in each toner hopper unit 20 to a developing chamber 30 described later (see FIG. 4) in each developing unit 21, and a discharge auger 23 for discharging toner in the developing chamber 30 described later to a waste toner accommodating chamber 25 described later in each toner hopper unit 20.

Providing the toner hopper unit 20 and the developing unit 21 separately in the developing units 10 increases the freedom of arranging these parts in the main case 2, thereby enabling the construction of a smaller device.

Figure 2:
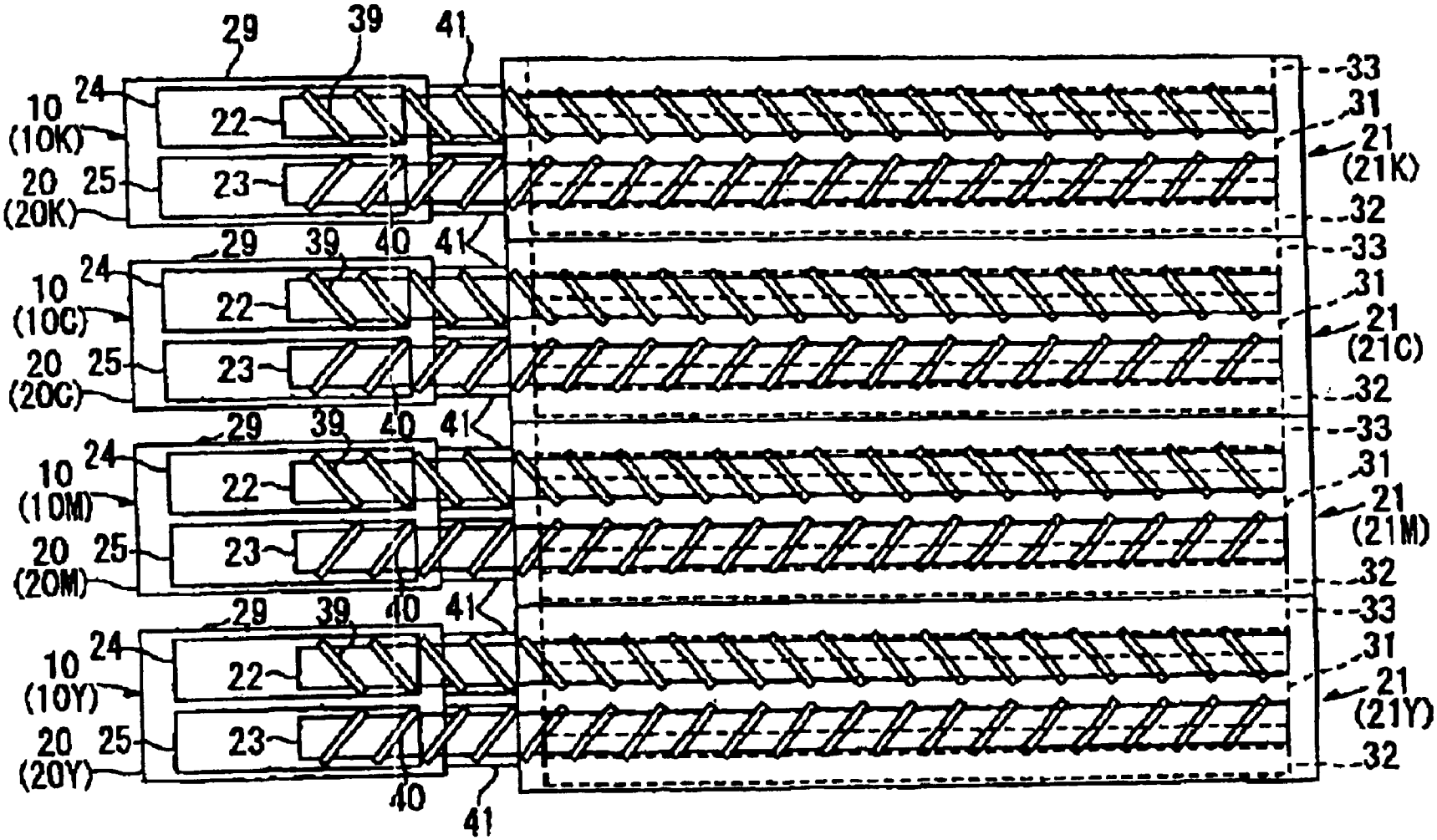
FIG. 2 is a back view showing the relevant parts of developing units in the color laser printer of FIG. 1.
Figure 3:
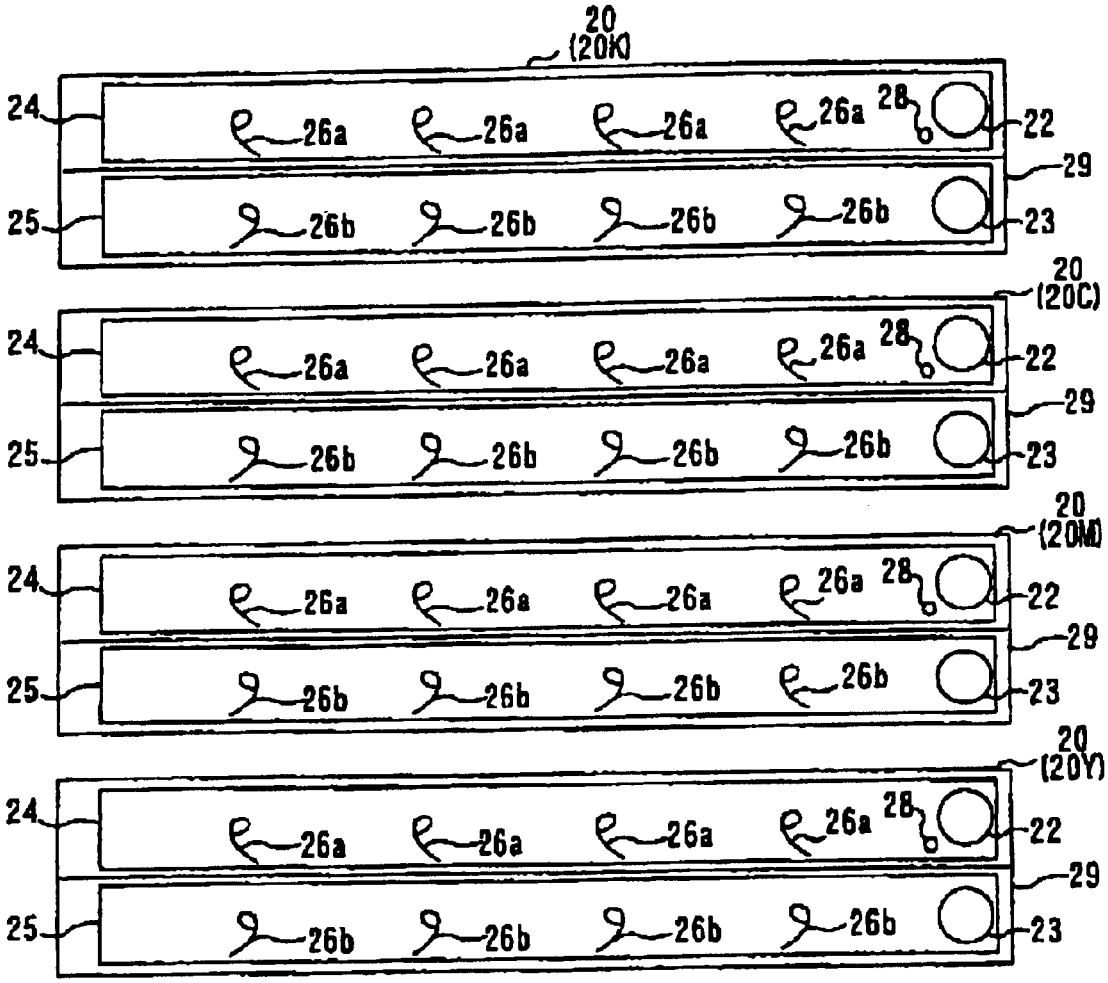
FIG. 3 is a side cross-sectional view showing the relevant parts of the toner hopper units in the color laser printer of FIG. 1.

As shown in FIGS. 2 and 3, the toner hopper unit 20 is formed in a box-shape having a substantially elongated rectangular shape. The toner hopper unit 20 is arranged in the front-to-back direction of the main case 2 and on one widthwise side therein (the nearside in FIG. 1).

Each toner hopper unit 20 includes a main case 29 and, within the main case 29, the accommodating chamber 24 for accommodating unused toner, and the waste toner accommodating chamber 25 for accommodating used toner. The toner hopper units 20 are stacked vertically.

The accommodating chamber 24 is formed in a box-shape having a substantially elongated rectangular shape. A plurality of agitators 26*a* is disposed in the accommodating chamber 24 at prescribed intervals along the lengthwise direction. By rotating these agitators 26*a*, toner in the accommodating chamber 24 is efficiently supplied to the supply auger 22 described later. Transparent windows 28 are provided in the toner supply side, that is, the supply auger 22 side, of the accommodating chamber 24. A toner hopper unit toner sensor 27 (see FIG. 5) detects the status of toner in the accommodating chamber 24 via the transparent windows 28.

Each of the accommodating chambers 24 accommodates a toner of a different color, including one of the colors yellow, magenta, cyan, and black. Each toner is a positively charged nonmagnetic single-component toner. Specifically, the toner used in the preferred embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1–C4) acrylate, or alkyl (C1–C4) meta acrylate. The polymerized toner is formed as particles substantially spherical in shape in order to have excellent fluidity. The toner is compounded with a coloring agent such as carbon black or wax, as well as an additive such as silica to improve fluidity. The diameter of the toner particles is about 6–10 $\mu$m.

Each accommodating chamber 24 is formed with a capacity for toner that is larger than the capacity of the developing chamber 30 of the developing unit 21 described later. More specifically, if the capacity of the developing chamber 30 is approximately 50 g (equivalent to 1000 sheets at 4% printing coverage), for example, the capacity of the accommodating chamber 24 is approximately 300 g (equivalent to 6000 sheets at 4% printing coverage), for example.

Since the accommodating chamber 24 can accommodate more toner than the developing chamber 30 with this construction, toner in the developing chamber 30 can be replaced by toner in the accommodating chamber 24 a number of times equivalent to the excess amount. This construction eliminates the problem of the accommodating chamber 24 quickly running out of toner and requiring that the toner hopper unit 20 be replaced frequently.

The waste toner accommodating chamber 25 is formed in a substantially elongated rectangular box-shape having nearly the same shape and size as the accommodating chamber 24. The waste toner accommodating chamber 25 is disposed below the accommodating chamber 24. A plurality of agitators 26*b* are disposed in the waste toner accommodating chamber 25 at prescribed intervals. By rotating these agitators 26*b*, recovered toner is conveyed away from the discharge auger 23, enabling a large amount of toner to be recovered.

Figure 4A:
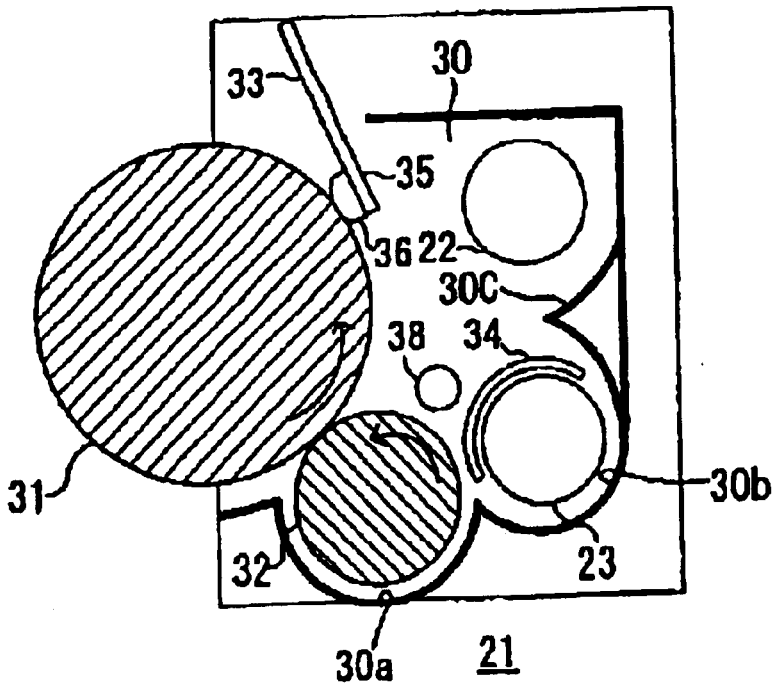
FIG. 4(*a*) is a side cross-sectional view showing the developing unit of the color laser printer of FIG. 1 wherein a shutter covers a discharge auger to shield from a developing chamber.
Figure 4B:
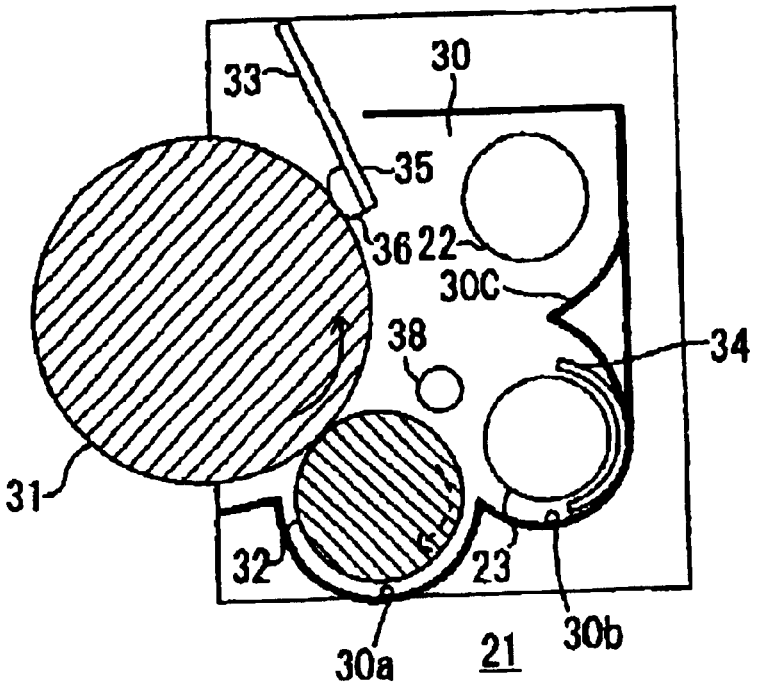

As shown in FIGS. 2 and 4, each of the developing units 21 is formed in a substantially elongated rectangular box shape. Each of the developing units 21 extends in the widthwise direction in the back side of the main case 2, on the opposite widthwise side as the toner hopper unit 20 and separated a prescribed distance therefrom.

Each developing unit 21 includes the developing chamber 30 and, within the developing chamber 30, a developing roller 31, a supply roller 32, a thickness regulating blade 33, and a shutter 34.

The developing chamber 30 is formed by a supply roller receiving depression 30*a* having a substantially arcuate cross section and disposed on the bottom of the developing chamber 30 for receiving the supply roller 32; a discharge auger receiving depression 30*b* having a substantially arcuate cross section and disposed on the back side of the supply roller receiving depression 30*a* for receiving the discharge auger 23; and a guide portion 30*c* disposed on the top of the discharge auger receiving depression 30*b* for guiding toner supplied from the supply auger 22 toward the supply roller 32.

The developing roller 31 is disposed in opposition to the photosensitive belt 44 described later and is rotatably supported in the developing chamber 30 such that the portion of the developing roller 31 opposing the photosensitive belt 44 is exposed from the developing chamber 30. The developing roller 31 includes a metal roller shaft covered by a roller member formed of a conductive rubber material. A motive force is transferred to the developing roller 31 from a main motor 70 (see FIG. 5) described later. During a developing operation, a developing bias is applied to the developing roller 31.

The supply roller 32 is rotatably supported in the developing chamber 30 behind and beneath the supply roller 32 such that the supply roller 32 is accommodated in the supply roller receiving depression 30*a* while contacting the developing roller 31 with pressure. The supply roller 32 includes a metal roller shaft covered by a roller member formed of a conductive sponge. A motive force is transferred to the supply roller 32 from the main motor 70 (see FIG. 5) described later. The supply roller 32 is capable of rotating in forward and reverse directions through the control of a CPU 61 described later.

The thickness regulating blade 33 is disposed above the supply roller 32, extending in the axial direction of the developing roller 31 and in confrontation with the same. The thickness regulating blade 33 includes a leaf spring member 35 supported on the inside of the developing chamber 30, and a pressing member 36 provided on the end of the leaf spring member 35. The pressing member 36 has a semicircular cross section and is formed of an insulating silicon rubber. With this construction, the elastic force of the leaf spring member 35 causes the pressing member 36 to contact the surface of the developing roller 31 on the side opposite that contacted by the photosensitive belt 44.

The shutter 34 is formed with a substantially arcuate cross section extending in the axial direction of the discharge auger 23 described later and partially encircling the same. The shutter 34 is selectively moved in a sliding motion around the discharge auger 23 by switching on and off the excitation of a solenoid 73 (see FIG. 5) through the control of the CPU 61. More specifically, the shutter 34 can be selectively switched between a closed position shown in FIG. 4(*a*) for cutting off the discharge auger 23 from the rest of the developing chamber 30 by facing in toward the discharge auger receiving depression 30*b*, and an open position shown in FIG. 4(*b*), wherein the shutter 34 is accommodated in the discharge auger receiving depression 30*b* to expose the discharge auger 23 to the developing chamber 30.

Figure 5:
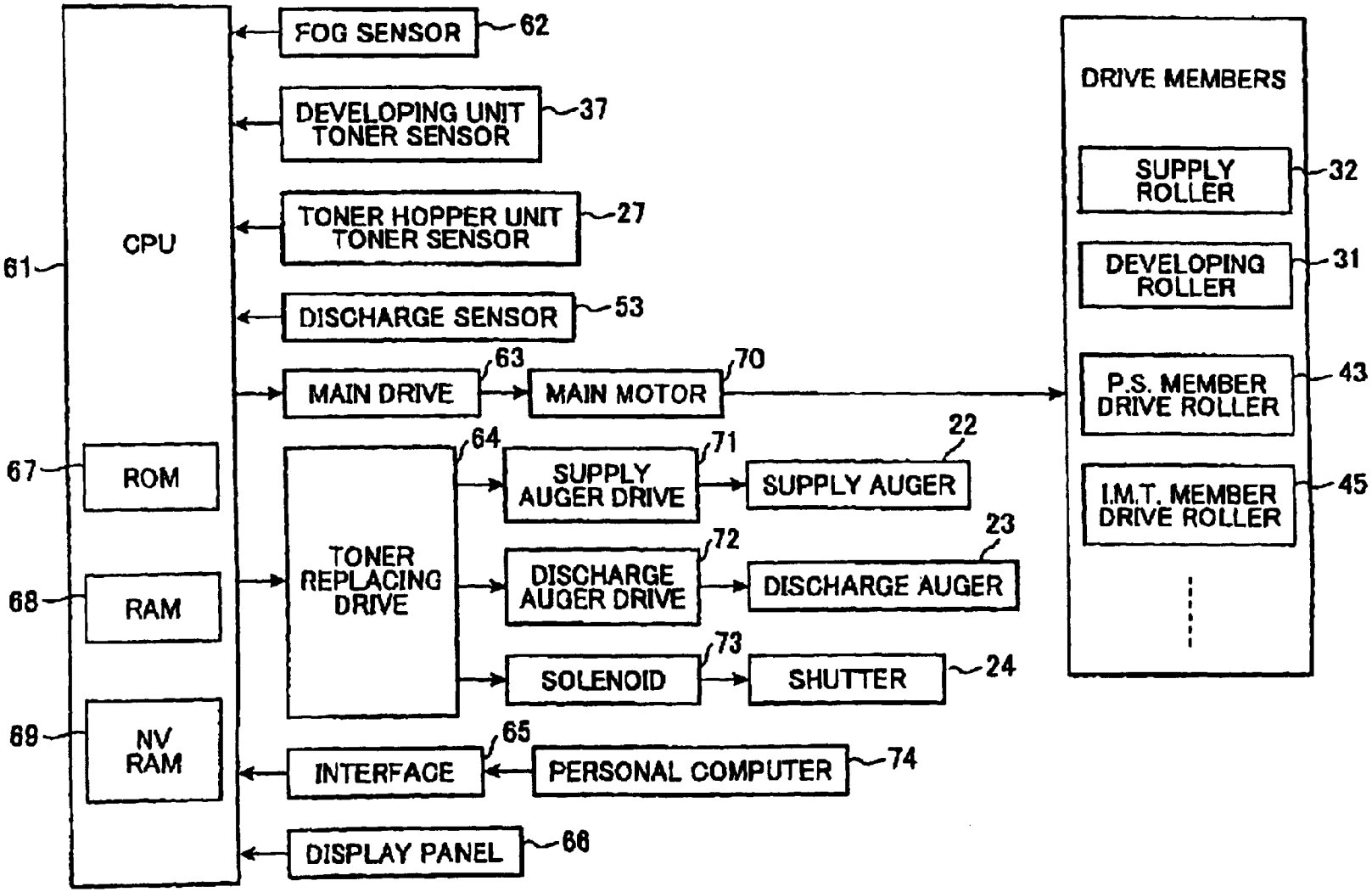
FIG. 5 is a block diagram showing the control system for executing the process of the toner replacement timing program.

Transparent windows 38 are provided in the side walls of the developing chamber 30 and towards the bottom thereof for detecting the remaining amount of toner with a developing unit toner sensor 37 (see FIG. 5).

As shown in FIG. 2, the supply auger 22 is rotatably supported on the toner hopper unit 20 and the developing unit 21 such that one end of the supply auger 22 is inserted into the accommodating chamber 24 of the toner hopper unit 20. The other end is inserted into the developing chamber 30 of the developing unit 21.

The portion of the supply auger 22 inserted into the accommodating chamber 24 is positioned near the back end of the accommodating chamber 24, as shown in FIG. 3, while the portion of the supply auger 22 inserted into the developing chamber 30 is positioned near the top of the guide portion 30*c* on the side of the developing chamber 30 opposite that of the developing roller 31 (diagonally upward from the supply roller 32) and is separated a described distance from the developing roller 31. A supply conveying fin 39 is formed in a spiral configuration around the circumference of the supply auger 22 for conveying toner from the accommodating chamber 24 to the developing chamber 30. A supply auger driving circuit 71 (see FIG. 5) drives the supply auger 22 to rotate through the control of the CPU 61 described later.

As shown in FIG. 2, each discharge auger 23 is disposed parallel to and along the axial direction of each supply auger 22 and is positioned below the same. The discharge auger 23 is rotatably supported on the toner hopper unit 20 and the developing unit 21 such that one end of the discharge auger 23 is inserted into the waste toner accommodating chamber 25 of the toner hopper unit 20, while the other end is inserted into the developing chamber 30 of the developing unit 21.

The end of the discharge auger 23 inserted into the waste toner accommodating chamber 25 is positioned near the back end of the waste toner accommodating chamber 25, as shown in FIG. 3. The end of the discharge auger 23 inserted into the developing chamber 30 is accommodated in the discharge auger receiving depression 30*b* and positioned on the opposite side of the developing chamber 30 from the supply roller 32 (diagonally downward from the developing roller 31). A discharge conveying fin 40 is formed in a spiral construction around the circumference of the discharge auger 23 for conveying toner from the developing chamber 30 into the waste toner accommodating chamber 25. A discharge auger driving circuit 72 (see FIG. 5) drives the discharge auger 23 to rotate through control by the CPU 61 described later.

A cylindrical connecting tube 41 is provided around each supply auger 22 and discharge auger 23 between the toner hopper unit 20 and developing unit 21 for preventing toner from falling.

When the shutter 34 is in the closed state shown in FIG. 4(*a*), toner is conveyed to the back end of the accommodating chamber 24 by the rotating drive of the agitators 26*a*, as shown in FIG. 3. By driving the supply auger 22, toner in the accommodating chamber 24 is conveyed into the developing chamber 30 of the developing unit 21.

Toner conveyed into the developing chamber 30 is supplied onto the developing roller 31 by the forward rotation of the supply roller 32, indicated by the arrow in FIG. 4(*a*) (counterclockwise direction). At this time, the toner supplied onto the developing roller 31 is positively tribocharged between the supply roller 32 and the developing roller 31. The toner carried on the developing roller 31 rotates along with the developing roller 31 in the direction indicated by the arrow (counterclockwise) and passes between the pressing member 36 of the thickness regulating blade 33 and the developing roller 31, forming a thin layer of toner having a uniform thickness on the developing roller 31.

After a prescribed time has elapsed, during which time toner has been degrading in the developing chamber 30, the shutter 34 is switched to the open position shown in FIG. 4(*b*) according to a toner discharge program described later. Next, the supply roller 32 rotates in a reverse direction opposite the direction of the rotation during the developing operation, as indicated by the broken arrow in FIG. 4(*b*) (clockwise direction), in order to supply toner to the discharge auger 23 rather than the developing roller 31. At this time the discharge auger 23 is driven to discharge toner in the developing chamber 30 toward the waste toner accommodating chamber 25.

By rotating the supply roller 32 in a reverse direction in this way, toner can be efficiently supplied to the discharge auger 23. Accordingly, existing parts can be used to discharge degraded toner from the developing chamber 30 efficiently through a simple control process by the CPU 61 described later.

It is preferable to dispose the supply roller 32 above the discharge auger 23, for example, in order to improve the efficiency of discharging toner from the developing chamber 30. On the other hand, providing the supply roller 32 above the discharge auger 23 can lead to a problem of toner accumulating in the developing chamber 30 during an image forming process described later, wherein the supply roller 32 cannot supply the toner to the developing roller 31.

However, since the supply roller 32 is provided to the side of the discharge auger 23 in the developing unit 21 of the present invention, toner can be efficiently supplied to the developing roller 31 during an image forming process while improving the efficiency of the discharging toner, thereby achieving high quality image formation.

Moreover, by closing the shutter 34 in the developing unit 21 during the image forming process described later to cut off the discharge auger 23 from the developing chamber 30, toner can be more efficiently circulated within the developing chamber 30. When discharging toner, the shutter 34 is opened in order to open the discharge auger 23 to the developing chamber 30 and enable toner in the developing chamber 30 to be efficiently discharged.

Each of the developing units 10 can be moved in the horizontal direction by a contacting/separating mechanism not shown in the drawings. In this way, the developing roller 31 in the developing unit 21 can be put into contact with or separated from the surface of the photosensitive belt 44 described later.

Further, the developing units 10 are detachably provided in the main case 2. Each of the toner hopper units 20 and developing units 21 are also detachably provided in each of the developing units 10. Accordingly, each of the toner hopper units 20 and developing units 21 can be independently and detachably mounted in the main case 2.

By detachably mounting the toner hopper units 20 in the main case 2, it is possible to replace the accommodating chamber 24 and the waste toner accommodating chamber 25 simultaneously. Accordingly maintenance can be simplified through a simple construction.

As shown in FIG. 1 the photosensitive belt mechanism 11 is disposed in a position confronting the front sides of the four developing units 21. The photosensitive belt mechanism 11 includes a photosensitive member support roller 42 opposing the yellow developing unit 21Y in the bottommost position; a photosensitive member drive roller 43 opposing the black developing unit 21K in the topmost position and positioned above the photosensitive member support roller 42; and the photosensitive belt 44, which is an endless belt looped around the photosensitive member support roller 42 and the photosensitive member drive roller 43.

A photosensitive layer formed of an organic photosensitive material is provided on the surface of the photosensitive belt 44. The photosensitive belt 44 extends vertically in order to contact all of the developing rollers 31.

When a motive force is transferred from the main motor 70 (see FIG. 5) described later to the photosensitive member drive roller 43 in the photosensitive belt mechanism 11, the photosensitive member drive roller 43 is driven to rotate in the counterclockwise direction. As the photosensitive member support roller 42 follows the rotations of the photosensitive member drive roller 43 by also rotating in the counterclockwise direction, the photosensitive belt 44 moves in a cycle between the photosensitive member support roller 42 and the photosensitive member drive roller 43 (in the counterclockwise direction).

The intermediate transfer belt mechanism 12 is disposed above the scanning unit 9 at a position opposing the front side of the photosensitive belt mechanism 11. The intermediate transfer belt mechanism 12 is provided with three rollers including an intermediate transfer member drive roller 45, the first intermediate transfer member support roller 46, a second intermediate transfer member support roller 47; and an intermediate transfer belt 48, which is an endless belt formed of a resin, such as a conductive polycarbonate or a polyimide including dispersed carbon or other conductive particles.

The intermediate transfer member drive roller 45 is disposed in opposition to the photosensitive member drive roller 43 such that the intermediate transfer belt 48 is interposed therebetween. The first intermediate transfer member support roller 46 is positioned diagonally down and toward the front of the main case 2 in relation to the intermediate transfer member driving roller 45 and is disposed in opposition to the transfer roller 13, such that the intermediate transfer belt 48 is interposed therebetween. The second intermediate transfer member support roller 47 is positioned below the intermediate transfer member driving roller 45 and toward the back of the main case 2 in relation to the first intermediate transfer member support roller 46. Hence, the intermediate transfer member driving roller 45, first intermediate transfer member support roller 46, and second intermediate transfer member support roller 47 are arranged in a substantially triangular shape around which the intermediate transfer belt 48 is looped.

The motive force from the main motor 70 (see FIG. 5) described later is transferred to the intermediate transfer member driving roller 45, causing the intermediate transfer member drive roller 45 to rotate in the clockwise direction of FIG. 1. The first intermediate transfer member support roller 46 and second intermediate transfer member support roller 47 are configured to follow the intermediate transfer member driving roller 45 by rotating in the clockwise direction, such that the intermediate transfer belt 48 runs in the clockwise direction around the intermediate transfer member driving roller 45, first intermediate transfer member support roller 46, and second intermediate transfer member support roller 47.

The transfer roller 13 is disposed in opposition to the first intermediate transfer member support roller 46, with the intermediate transfer belt 48 interposed therebetween, such that the transfer roller 13 contacts the surface of the intermediate transfer belt 48. The transfer roller 13 rotates in the counterclockwise direction, such that the surface of the transfer roller 13 moves in the same direction as the intermediate transfer belt 48 at the point of contact with the intermediate transfer belt 48 (nip point). The transfer roller 13 is configured to contact the intermediate transfer belt 48 (indicated by the solid line) when transferring a color image onto a sheet of the paper 3 and to separate from the same (indicated by the dotted line) when not performing a transfer operation by means of the contacting/separating mechanism, not shown in the drawings. Further, the transfer roller 13 applies a transfer bias to the intermediate transfer belt 48.

The Scorotron charging device 14 is disposed not in contact with the surface of the photosensitive belt 44, but a prescribed distance therefrom, and is positioned near the photosensitive member support roller 42 on the upstream side of the same in relation to the movement of the photosensitive belt 44. The Scorotron charging device 14 is a positive-charging Scorotron type charger for generating a corona discharge from a tungsten wire or the like. The Scorotron charging device 14 is configured to apply a positive charge uniformly across the surface of the photosensitive belt 44.

After the Scorotron charging device 14 applies a uniform positive charge to the surface of the photosensitive belt 44, the surface is exposed by the high-speed scanning of the laser beam emitted from the scanning unit 9, thereby forming latent images according to prescribed image data.

Next, when the connecting/separating mechanism (not shown) places the developing roller 31 of a particular developing unit 21 in contact with the photosensitive belt 44 on which a latent image has been formed, then a toner image is formed on the photosensitive belt 44 in the single color of the toner stored in that specific developing unit 21, when the toner image of this color formed on the photosensitive belt 44 is brought opposite the intermediate transfer belt 48, the toner image is transferred onto the intermediate transfer belt 48. A color image is formed by sequentially overlaying images of different colors on the intermediate transfer belt 48.

For example, let us say the connecting/separating mechanism (not shown) moves the yellow developing unit 21Y positioned at the bottom of the main case 2 horizontally toward the front of the main case 2, such that the developing roller 31 in the yellow developing unit 21Y contacts the photosensitive belt 44 on which a latent image has been formed, and the developing cartridges 21M, 21C, and 21K are moved horizontally toward the back of the main case 2, thereby separating the respective developing rollers 31 from the photosensitive belt 44. Accordingly, a toner image in yellow is formed on the photosensitive belt 44 by the yellow toner stored in the yellow developing unit 21Y. Next, when the yellow toner image on the photosensitive belt 44 moves across from the intermediate transfer belt 48, the yellow image is transferred to the intermediate transfer belt 48.

By repeatedly forming latent images on the photosensitive belt 44 as described above and appropriately moving each developing unit 21 horizontally with the connecting/separating mechanism, the developing roller 31 of the magenta developing unit 21M positioned second from the bottom can be placed in contact with the photosensitive belt 44, while the remaining developing rollers 31 are separated therefrom, to form a toner image in magenta on the photosensitive belt 44 using the magenta toner stored in the magenta developing unit 21M. Similarly when the magenta toner image is rotated across from the intermediate transfer belt 48, the magenta image is transferred to the intermediate transfer belt 48 and superimposed on the yellow toner image that was transferred previously.

The same operations are repeated using cyan toner stored in the cyan developing unit 21C and black toner stored in the black developing unit 21K to form a multicolor image on the surface of the intermediate transfer belt 48. The multicolor image formed on the surface of the intermediate transfer belt 48 is transferred at once onto the paper 3, as the paper 3 passes between the intermediate transfer belt 48 and the transfer roller 13.

A cleaner not shown in the drawings is provided downstream from the photosensitive member drive roller 43 in the direction of movement by the photosensitive belt 44 for cleaning a single color of toner remaining on the photosensitive belt 44. Accordingly, after each color is formed and transferred to the intermediate transfer belt 48, the cleaner cleans the single color of toner remaining on the photosensitive belt 44.

Further, a cleaner not shown in the drawings is provided downstream from the first intermediate transfer member support roller 46 in the direction of movement by the intermediate transfer belt 48 for cleaning multiple colors of toner remaining on the intermediate transfer belt 49. Accordingly after multiple colors of toner are formed and transferred to the transfer roller 13, the cleaner cleans the multiple colors of toner remaining on the intermediate transfer belt 48.

The fixing unit 15 is disposed above the transfer roller 13. The fixing unit 15 includes a heating roller 49, and a pressure roller 50 applying pressure to the heating roller 49. The heating roller 49 is formed of metal and includes a halogen lamp for generating heat. The heat generated by the heating roller 49 fixes a color image transferred onto the surface of the paper 3 as the three passes between the heating roller 49 and the pressure roller 50. After the color image is fixed on the paper 3 in the fixing unit 15, the paper 3 is conveyed to a pair of discharge rollers 51 disposed above the fixing unit 15. The discharge rollers 51 discharge the paper 3 onto a discharge tray 52 formed on top of the main case 2.

A discharge sensor 53 is disposed between the fixing unit 15 and the discharge rollers 51 along the discharging path of the paper 3. The discharge sensor 53 includes an actuator **53*a* that pivots when contacted by the discharging paper 3. The actuator 53*a* tilts towards the discharging path of the paper 3 and pivots toward the discharging direction when contacted by the leading edge of the paper 3. After the trailing edge of the paper 3 separates from the actuator 53*a*, the actuator 53*a*returns to its original position (tilting toward the discharging path). The discharge sensor 53 is connected to the CPU 61 described later. The CPU 61 counts one sheet of the paper 3 each time the actuator 53*a*** pivots.

As described above, the laser printer 1 employs a nonmagnetic, single-component developing method that uses a positively charged toner and achieves the developing unit 21 with a simple construction. However, during the image forming operation described above, toner in the developing chamber 30 slides with friction between the supply roller 32 and the developing roller 31 and slides with friction between the developing roller 31 and the pressing member 36 of the thickness regulating blade 33, causing the toner to deteriorate gradually. Accordingly, when developing electrostatic latent images on the photosensitive belt 44 using such deteriorated toner, a decline in image quality occurs when fog or the like is generated due to the toner adhering to unexposed areas.

When fog is generated on the surface of the photosensitive belt 44 in the laser printer 1 of the present invention, the CPU 61 controls the shutter 34 to open and drives the discharge auger 23 to rotate, thereby discharging used deteriorated toner from the developing chamber 30 into the waste toner accommodating chamber 25. After the discharging operation is completed, the shutter 34 is closed and the accommodating chamber 24 is driven to rotate, thereby supplying new, unused toner into the developing chamber 30 from the accommodating chamber 24. Hence, almost all of the toner in the developing chamber 30 is replaced with new, unused toner.

FIG. 5 is a block diagram showing a control system for executing the above control processes.

As shown in FIG. 5, the CPU 61 is connected to a fog sensor 62, the developing unit toner sensor 37, the toner hopper unit toner sensor 27, the discharge sensor 53, a main drive circuit 63, a toner replacing drive circuit 64, an interface 65, and a display panel 66.

The CPU 61 includes a ROM 67, a RAM 68, and a NVRAM 69. In the laser printer 1 of the present invention, the ROM 67 stores an image forming program for executing image forming operations based on jobs inputted from a personal computer 74, as well as a toner replacement timing program and a toner discharge program for executing the toner replacing operation described above. The main drive circuit 63 temporarily stores numerical values and the like set by each of the above programs. The NVRAM 69 stores accumulated rotations of the developing roller 31 in an encoder described later, a number of pages counted by the discharge sensor 53 described later, an accumulated amount of image formation area described later, and the like. The NVRAM 69 is configured to continue storing such numerical values, even when the power to the laser printer 1 is turned off, by means of a backup battery.

As shown in FIG. 1, the fog sensor 62 is disposed downstream from the four developing rollers 31 in the moving direction of the photosensitive belt 44 and opposes the photosensitive member drive roller 43 while separated a prescribed distance therefrom. The fog sensor 62 is configured of an optical sensor having a light-emitting element and a light-receiving element and is disposed along a region of the photosensitive belt 44 outside the image forming region (the region in which electrostatic latent images are formed). The fog sensor 62 is configured to detect fog according to the ratio of light emitted by the light-emitting element that is reflected by the photosensitive belt 44 and received by the light-receiving element.

More specifically, when toner in the developing chamber 30 begins to deteriorate, the toner begins to lose its ability to be charged. This deteriorating toner adheres to unexposed areas, including areas outside the image forming area of the photosensitive belt 44, and generates fog. In the meantime, the light-emitting element of the fog sensor 62 emits light toward an area outside the image forming region of the photosensitive belt 44. The light-receiving element of the fog sensor 62 receives light reflected from the photosensitive belt 44. If fog is generated in this external area, the ratio of reflected light is reduced and the ratio of light received by the light-receiving element is low. Accordingly the CPU 61 detects fog based on a low ratio of a light received by the fog sensor 62.

The developing unit toner sensor 37 is provided for each of the developing units 21 and is configured by an optical sensor having a light-emitting element and a light-receiving element that confront each other across the transparent windows 38. When the developing chamber 30 is sufficiently full of toner, the toner blocks light emitted by the light-emitting element of the developing unit toner sensor 37. However, when the developing chamber 30 is empty of toner, the light emitted by the light-emitting element passes through the developing chamber 30 and is received by the light-receiving element of the developing unit toner sensor 37. The voltage outputted from the light-receiving element varies according to the amount of light received by the light-receiving element. That is, when no light is received, a high voltage is outputted. However, when a large amount of light is received, a low voltage is outputted. Hence, by detecting changes in the output voltage, the CPU 61 can determine the amount of toner in the developing chamber 30. For example, when the output voltage during a prescribed period is less than a first prescribed amount (when there is sufficient toner), the CPU 61 determines that the developing chamber 30 is full. When the ratio of output voltages during this prescribed period is greater than or equal to a second prescribed amount (when little toner remains), the CPU 61 determines that the developing chamber 30 is empty. When the ratio of output voltages during this prescribed period is greater than or equal to the first prescribed amount and less than the second prescribed amount (when the toner is low), then the CPU 61 determines that the toner is low.

The toner hopper unit toner sensor 27 is provided for each of the accommodating chambers 24 and is configured by an optical sensor having a light-emitting element and a light-receiving element that confront each other across the transparent windows 28. When the accommodating chamber 24 is sufficiently full of toner, the toner blocks light emitted by the light-emitting element of the toner hopper unit toner sensor 27. However, when the accommodating chamber 24 is empty of toner, the light emitted by the light-emitting element passes through the accommodating chamber 24 and is received by the light-receiving element of the toner hopper unit toner sensor 21. The voltage outputted from the light-receiving element varies according to the amount of light received by the light-receiving element. That is, when no light is received, a high voltage is outputted. However, when a large amount of light is received, a low voltage is outputted. Hence, by detecting changes in the output voltage, the CPU 61 can determine the amount of toner in the accommodating chamber 24. For example, when the output voltage during a prescribed period is less than a third prescribed amount (when there is sufficient toner), the CPU 61 determines that the accommodating chamber 24 is full. When the ratio of output voltages during this prescribed period is greater than or equal to a fourth prescribed amount (when little toner remains), the CPU 61 determines that the accommodating chamber 24 is empty. When the ratio of output voltages during this prescribed period is greater than or equal to the third prescribed amount and less than the fourth prescribed amount (when the toner is low), then the CPU 61 determines that the toner is low.

As described above, the discharge sensor 53 inputs the pivot operation of the actuator 53*a* into the CPU 61 at each pivot operation. The CPU 61 counts the number of pivots using an internal counter and stores the count in the NVRAM 69.

In the laser printer 1 of the present invention, the main motor 70 is also connected to various drive members, including the supply roller 32, the developing roller 31, the photosensitive member drive roller 43, and the intermediate transfer member drive roller 45. Through the control of the CPU 61, the main motor 70 is driven via the main drive circuit 63 to drive each of the drive members.

The toner replacing drive circuit 64 is a drive circuit for executing a toner discharge program described later. The toner replacing drive circuit 64 is connected to the supply auger driving circuit 71, the discharge auger driving circuit 72, and the solenoid 73.

The supply auger 22 is connected to the supply auger driving circuit 71. Accordingly, the supply auger 22 is driven to rotate by the toner replacing drive circuit 64 and the supply auger driving circuit 71 under the control of the CPU 61.

The discharge auger 23 is connected to the discharge auger driving circuit 72. Accordingly the discharge auger 23 is driven to rotate by the toner replacing drive circuit 64 and the discharge auger driving circuit 72 under the control of the CPU 61.

The shutter 34 is connected to the solenoid 73. Accordingly the shutter 34 is selectively moved in a sliding motion between the open position and the closed position through the control of the CPU 61, which turns on and off the excitation of the solenoid 73.

The personal computer 74 is connected to the interface 65. Jobs transmitted from the personal computer 74 are inputted to the CPU 61.

The display panel 66 includes LEDs or the like for displaying various settings. The display panel 66 displays various data under the control of the CPU 61.

Next, the process of the toner replacement timing program using the control system described above will be described with reference to FIG. 6.

The process of the toner replacement timing program starts when a job is inputted from the personal computer 74. At the beginning of this process, the CPU 61 checks for fog in S1. In S2 the CPU 61 determines whether fog exists. If the CPU 61 determines that no fog exists S2: YES), then in S3 the image forming program executes an image forming process for each sheet of the paper 3. After the image forming process on the paper 3 is completed, the CPU 61 determines in S4 whether the developing chamber 30 in any of the developing units 21 is empty of toner. If the CPU 61 determines that none of the developing units 21 is empty (S4: NO), then in S5 the CPU 61 determines whether the job is completed. If the job is completed (that is, if there are no jobs left to print; S5: YES), then the current process ends. However, if the CPU 61 determines that the job is not completed (that is, if there are remaining sheets of the job to print; S5: No), then the CPU 61 again checks for fog in S1. After a negative determination in S2, the image forming process is executed in S3. This series of the image forming process from S1 to S4 is repeated until the job is completed (S5: YES).

If the CPU 61 determines that at least one of the developing units 21 is empty (S4: YES), then in S6 the CPU 61 starts the toner discharge program to execute a toner discharge process.

Figure 7:
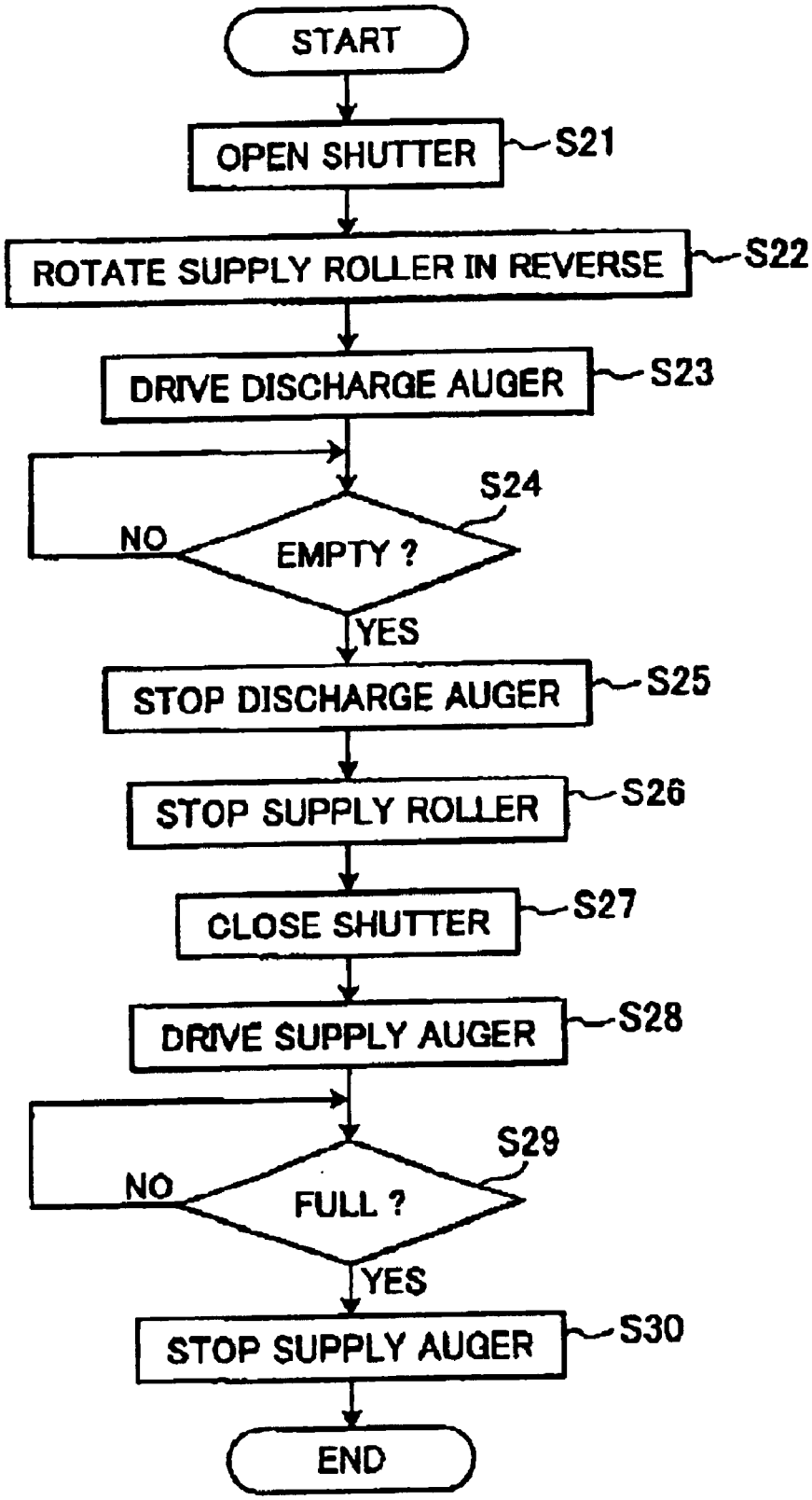
FIG. 7 is a flowchart showing the steps in the process of the toner discharge program, wherein a supply operation is executed by the supply auger after a discharge operation is executed by the discharging auger.

FIG. 7 shows a flowchart of the toner discharge process. First in S21, while all of the developing rollers 31 are separated from the photosensitive belt 44, an operation is executed to open each shutter 34 in the developing units 21 by turning on and off excitation of the solenoid 73. In S22 each supply roller 32 is driven in the reverse direction. In S23 all of the discharging augers 23 are driven. In this way, the discharge operation of the discharge auger 23 is executed to discharge toner from the developing chamber 30 into the waste toner accommodating chamber 25. As a result, toner is discharged uniformly even for developing units 21 that were not out of toner. The discharge auger 23 continues the discharging operation as long as the CPU 61 determines that the developing chamber 30 has not reached an empty state (S24: NO) When the CPU 61 determines that the discharge auger 23 has reached an empty state (S24: YES), then in S25 the discharge auger 23 is stopped and in S26 the supply roller 32 is stopped. Through this operation, the developing chamber 30 of each developing unit 21 is now nearly completely empty of toner.

In S27, all of the shutters 34 are closed by turning on or off the excitation of the solenoid 73. In S28, all of the discharging augers 23 are driven to execute a supply operation. The discharge auger 23 supplies toner from the accommodating chamber 24 into the developing chamber 30, thereby supplying toner uniformly to all of the developing units 21. In S29, the CPU 61 determines whether each of the developing chambers 30 is full of toner. When the CPU 61 determines that each of the developing chamber 30 has reached a full state (S29: YES), then in S30, each of the discharging augers 23 is stopped after a prescribed time has elapsed from the time of the determination, and the process ends.

By executing this toner discharge process according to the toner discharge program, deteriorated toner in all of the developing chambers 30 is replaced with new toner with almost no mixing of deteriorated toner and new toner.

Figure 6:
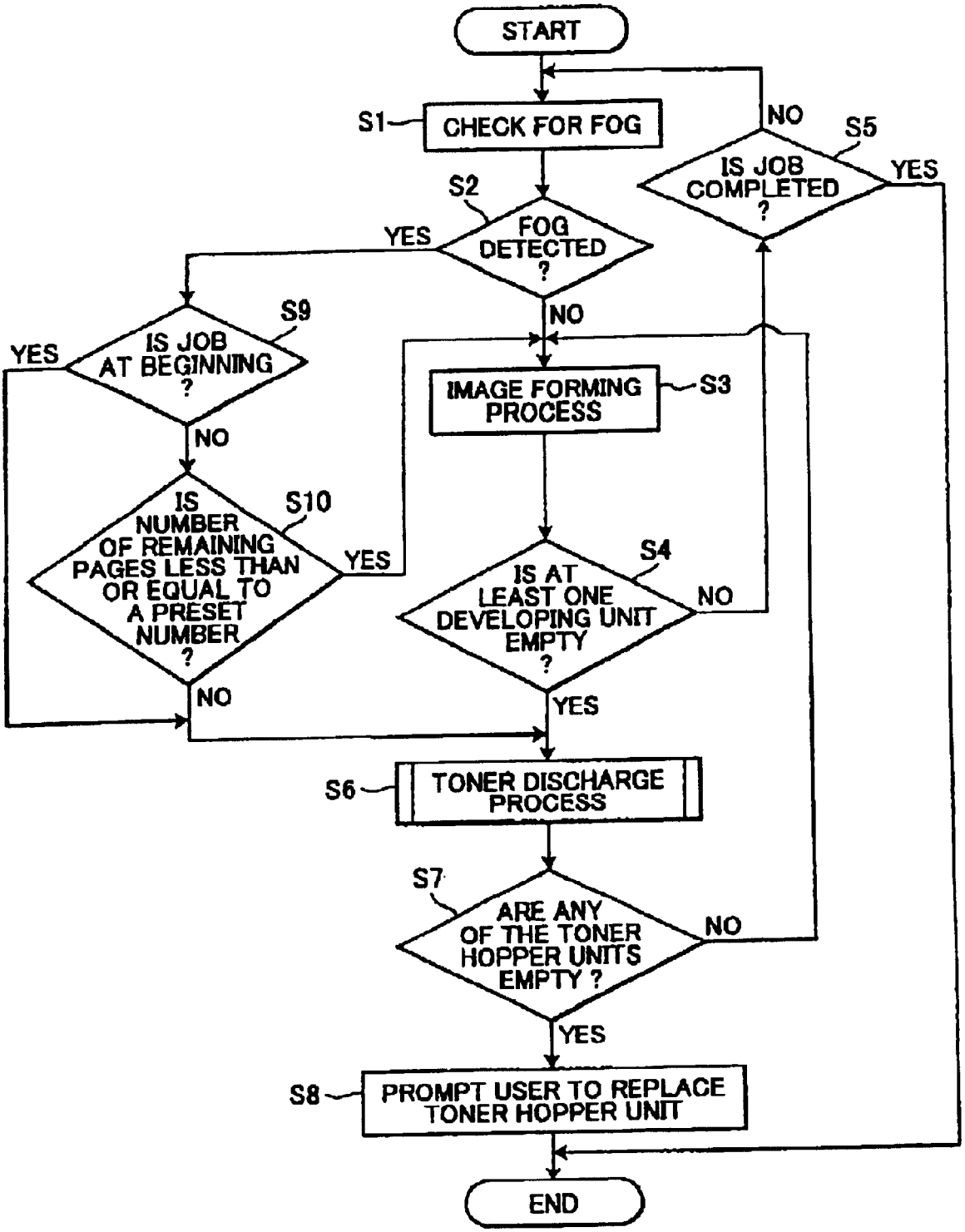
FIG. 6 is a flowchart showing the steps in the process of the toner replacement timing program.

After the toner discharging process in S6 of FIG. 6 is completed, the CPU 61 determines in S7 whether the accommodating chamber 24 in each of the toner hopper units 20 is empty of toner. If the CPU 61 determines that the accommodating chamber 24 in any of the toner hopper units 20 is empty (S7: YES), then in S8 a message prompting the user to replace the toner hopper unit 20 is displayed on the display panel 66, and the process ends.

However, if the CPU 61 determines that the accommodating chamber 24 in any of the toner hopper units 20 is not empty (S7: NO), then the process returns to S3 for executing the image forming process, and the series of steps S1–S4 in the image forming process is repeated until the job is completed.

If the CPU 61 determines that fog has been generated during this process (S2: YES), then the CPU 61 determines in S9 whether the image forming process has just begun. If the job has just been started and the image forming process has not yet been performed for the first sheet of paper 3 in the job (S9: YES), then the toner discharge process of S6 described above is executed regardless of the number of sheets remaining in the job and without determining this number in S10. However, if the job has not just started, that is, if the image forming process has already been performed on one or more sheets of the paper 3 in the job (S9: NO), then in S10 the CPU 61 determines if the number of remaining sheets of paper 3 in the job is less than or equal to a predetermined number of sheets. If the number of remaining sheets in the job is not less than or equal to the predetermined number (S10: NO), then the toner discharge process in S6 described above is executed. However, if the number of remaining sheets in the job is less than or equal to the predetermined number (S10: YES), then the series of steps in the image forming process (S1–S4) is performed for each of the remaining sheets in the job without executing the toner discharge process of S6.

Hence, if the number of remaining sheets in a job is within a predetermined number that is not very large when the CPU 61 determines that fog has been generated (S2: YES), the present invention eliminates the need to interrupt the image forming process just to perform the toner discharge process of S6 and enables the image forming process to be executed for the remaining sheets in the job while the image quality is still not diminished much by the effects of the fog. Interrupting the image forming process, on the other hand, would have the effect of lowering productivity and undermining practical convenience.

Here, the preset number of sheets is set to a number of sheets that can satisfactorily undergo image formation without suffering a great drop in image quality due to the fog, for example, about 5–10 sheets. Therefore, even when fog is detected, the image forming process can be continued on the remaining sheets of paper without executing the toner discharge process, provided that the number of remaining sheets in the job is found to be less than or equal to this preset number in the process of S10. Hence, the present invention can simplify the control process and speed up the image forming process by eliminating the need to temporarily interrupt the series of steps in an image forming process to execute the toner discharge process.

However, if fog is detected (S2: YES), at the beginning of the job, that is, before the image forming process has been performed on the first sheet of paper 3 in a job (S9: YES), then the toner discharge process of S6 described above is executed regardless of the number of sheets of paper remaining in the job. Subsequently, the series of steps S1–S4 in the image forming process is executed for this job.

By executing the toner discharge process prior to starting the job, the image forming process need not be interrupted, preventing problems that are associated with such interruptions. Hence, when fog is detected at the beginning of a job, the toner discharge process is executed to emphasize maintenance of image quality, regardless of the number of sheets in the job and even when the number of sheets in the job is low. After executing the toner discharge process, the image forming process is executed for the job, thereby maintaining a high quality in image formation.

In the process of the toner replacement timing program, the toner discharge process is executed when the CPU 61 detects toner fog having been generated on the surface of the photosensitive belt 44 (that is, when deterioration of toner is detected) based on the fog sensor 62. Accordingly good image quality can be maintained by replacing the toner in the developing chamber 30 with new toner at an appropriate timing corresponding to actual degradation of toner. Therefore, high quality image formation can be maintained by efficiently replacing deteriorated toner with new toner, even in a nonmagnetic, single-component developing system employing positively charged toner susceptible to degradation.

Moreover, deteriorated toner in the developing chamber 30 can be replaced with new toner in the toner discharge process with little mixing of new toner with deteriorated toner in the developing chamber 30. Therefore, image quality can be improved by replacing deteriorated toner with new toner while controlling fog caused by the mixing of deteriorated toner and new toner.

Further, this toner discharging process executes operations to discharge degraded toner and to supply new toner for all colors, that is, for the developing chamber 30 in all developing units 21. Hence, the present invention effectively prevents a drop in image quality caused by an imbalance of color.

In other words, when executing the toner discharge process for only one of a plurality of colors, only the toner for that color is replaced with new toner, thereby creating in imbalance between that color and the colors of other toners and decreasing the image quality. However, when executing the toner discharging process for toner of all colors, new toner is provided for all colors, thereby maintaining the balance of these colors. Accordingly the present invention can effectively prevent a drop in image quality caused by an imbalance in color.

However, depending on the usage objectives and applications of the laser printer 1, the toner discharge process of FIG. 6 can be executed for only the developing unit 21 determined to be empty in 54, for example, without replacing toner for all colors. Further, the toner discharge process of S6 can be executed for only the developing unit 21 corresponding to the toner for which fog is detected in S2.

It is also possible to execute the toner discharge process of S6 for only the yellow developing unit 21Y, the magenta developing unit 21M, and the cyan developing unit 21C when black toner is not required in the job, for example.

Figure 8:
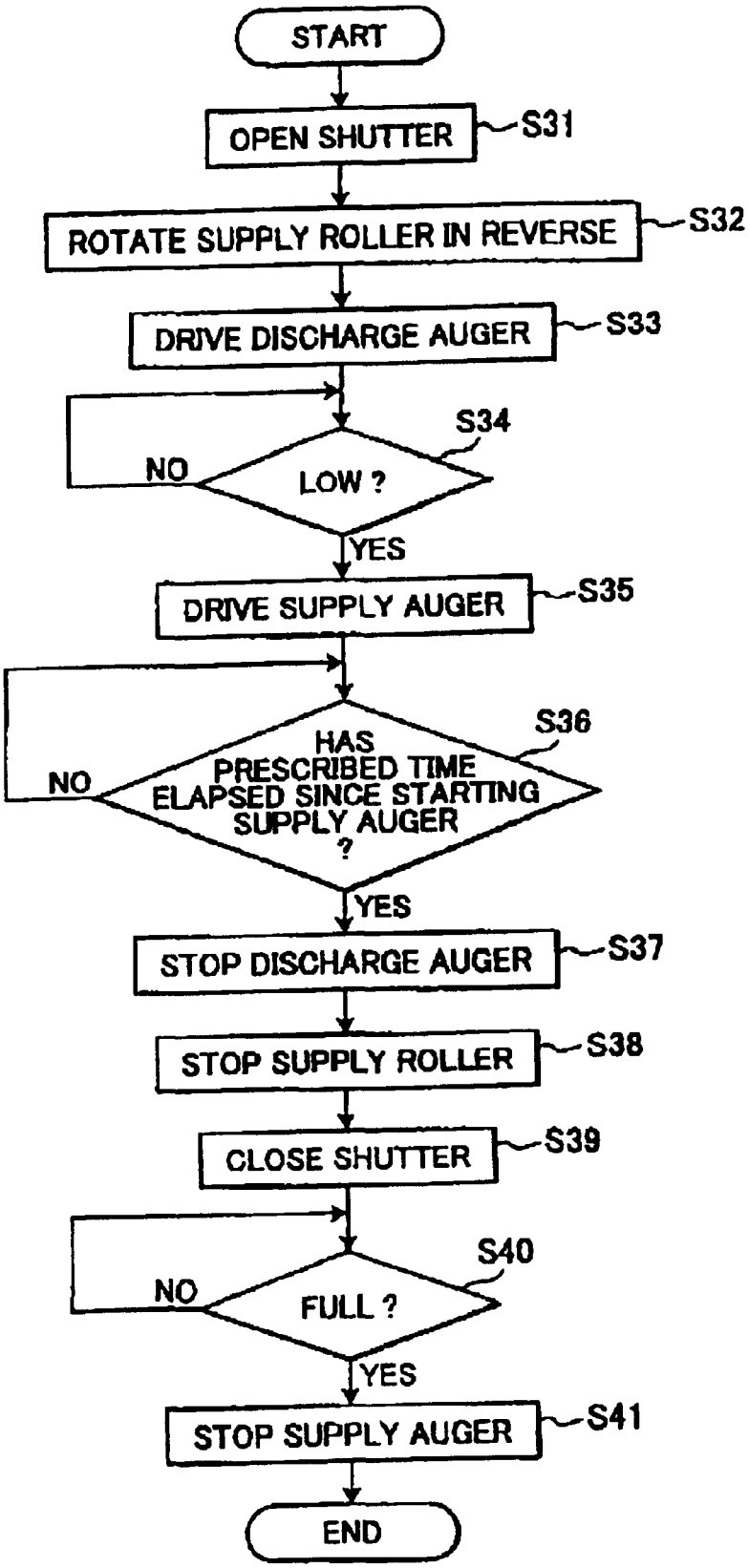
FIG. 8 is a flowchart showing the steps in the process of the toner discharge program, wherein the discharge operation by the discharging auger and the supply operation by the supply auger are executed simultaneously at one point.

After the discharge operation of the discharge auger 23 is completed in the toner discharge process described above, and the developing chamber 30 is in a state nearly empty of toner, the developing chamber 30 is then filled with toner to a full state by the supplying operation of the supply auger 22. However, the developing chamber 30 can also be filled with toner up to a prescribed amount (full state) after up to a prescribed amount of old toner has been discharged from the developing chamber 30 by the discharging operation of the discharge auger 23. In the following description, the point at which the remaining toner in the developing chamber 30 reaches a prescribed amount while toner is being discharged is the point at which the CPU 61 determines the remaining amount of toner to be "low." At this point, fog is not generated when new toner is mixed with the remaining amount of degraded toner. More specifically, the mixing ratio of new toner to old toner is about 10:1 in the case of positively charged polymerized toner and about 5:1 in the case of positively charged ground toner. This toner discharging process will be described next with reference to FIG. 8.

As in the toner discharging process described with reference to FIG. 6, this process begins in S31 by turning on and off the excitation of the solenoid 73 to open the shutter 34 in the developing unit 21. In S32 the supply roller 32 is rotated in the reverse direction. In S33 the discharge auger 23 is driven to perform a discharge operation, thereby discharging toner from the developing chamber 30 into the waste toner accommodating chamber 25. As long as remaining toner in the developing chamber 30 has not reached a prescribed amount (S34: NO), the discharge auger 23 continues the discharge operation. However, when the toner remaining in the developing chamber 30 reaches the prescribed amount, that is, when the CPU 61 determines that the amount of toner remaining in the developing chamber 30 is low (S34: YES), then in S35 the supply auger 22 is driven. As song as a prescribed time has not elapsed since beginning to drive the supply auger 22 (S36: NO) the discharge operation by the discharge auger 23 and supply operation by the supply auger 22 are continued. After the prescribed time has elapsed (S36: YES), the discharge auger 23 is stopped in S37 and the supply roller 32 is stopped in S38. In S39 the shutter 34 is closed by turning on or off the excitation of the solenoid 73.

In S40 the CPU 61 determines whether the developing chamber 30 is full of toner. If the CPU 61 determines that the developing chamber 30 is full (S40: YES), then in S41 the supply auger 22 is stopped when a prescribed time has elapsed after the point of determination, and the process ends.

With this toner discharge process, degraded toner in the developing chamber 30 can be replaced with new toner while minimizing the amount of degraded toner that is mixed with new toner in the developing chamber 30. Accordingly, the present invention can improve image quality by replacing degraded toner with new toner while suppressing fog caused by the mixing of the degraded toner with new toner. In this toner discharge process, both the discharge operation by the discharge auger 23 and the supply operation by the supply auger 22 are executed simultaneously at one point. Hence, the time required to execute the process can be shortened while improving the efficiency of discharging degraded toner using the pressure of the new toner.

In the toner discharge process described above, control is executed based on the amount of toner in the developing chamber 30, that is, whether the developing chamber 30 is in an empty, low, or full state. However, by setting an internal timer in the CPU 61 to a prescribed time, this control can be executed based on the prescribed time. Specifically, the CPU 61 may drive the supply auger 22 after the discharge auger 23 is driven for the prescribed time.

While the fog sensor 62 is disposed in opposition to the photosensitive belt 44 in the laser printer 1 of the present embodiment, the fog sensor 62 can be disposed in opposition to the intermediate transfer belt 48 instead, for example.

In the process of the toner replacement timing program described above, the toner discharge process is executed when fog is detected. However, some other method for detecting toner deterioration can also be used. For example, an encoder or the like can be used to count the number of rotations of each developing roller 31, and the counted number of rotations can be stored in the NVRAM 69. Here, toner in one of the developing chamber 30 is determined to have deteriorated when the stored number of rotations for the corresponding developing roller 31 reaches a preset prescribed number of rotations. At this point, the toner discharge process can be executed.

Further, instead of the number of revolutions of the developing roller 31, the count inputted from the discharge sensor 53 can be accumulated and stored in the NVRAM 69. Here, toner in the developing chamber 30 is considered degraded when the count stored in the NVRAM 69 reaches a predetermined prescribed count. At this point, the toner discharge process is executed.

It is also possible to accumulate the amount of image formation coverage area based on image data of jobs inputted from the personal computer 74 and to store this amount in the NVRAM 69. Here, toner in the developing chamber 30 is considered degraded when the accumulated amount of image formation coverage area stored in the NVRAM 69 reaches a predetermined prescribed amount. At this point, the toner discharge process is executed.

By detecting toner deterioration in the developing chamber 30 in this way, the toner discharge process can be reliably executed through a simple control process.

The numerical values (number of rotations, paper discharge count, and printing coverage area) accumulated in the NVRAM 69 for detecting toner deterioration in the developing chamber 30 are reset to an initial value each time the toner discharge process is executed.

While each of the toner hopper units 20 in the laser printer 1 of the preferred embodiment is provided with the accommodating chamber 24 and the waste toner accommodating chambers 25, a waste toner accommodating chamber 25 need not be provided for each toner hopper unit 20, for example. Instead, the laser printer 1 can be configured with one waste toner accommodating chamber 25 for a plurality of developing chambers 30, the waste toner accommodating chamber 25 being capable of collecting and storing toner discharged from each developing chamber 30.

While the laser printer 1 was used as the image forming device of the present invention in the embodiment described above, the image forming device of the present invention can also be a monochrome laser printer.

What is claimed is:

1. An image forming device comprising:

a photosensitive member on which a latent image is formed;

a developing chamber;

a developing member that is housed in the developing chamber and develops the latent image with toner, waste toner that is deteriorated in quality staying in the developing chamber;

an accommodating chamber that accommodates toner;

a waste toner accommodating chamber that accommodates waste toner;

a supply auger that supplies toner from the accommodating chamber to the developing chamber;

a discharge auger that discharges toner from the developing chamber into the waste toner accommodating chamber; and a controller that controls the supply auger and the discharge auger, wherein the controller executes a toner replacing process for driving the discharge auger to discharge waste toner from the developing chamber and for subsequently driving the supply auger to supply toner from the accommodating chamber to the developing chamber.

2. The image forming device according to claim 1, wherein the controller drives the supply auger after the discharge auger discharges a prescribed amount of waste toner.

3. The image forming device according to claim 1, wherein the controller drives the supply auger after the discharge auger is driven for a predetermined period of time.

4. An image forming device according to claim 1, further comprising a deterioration detector that detects deterioration in quality of toner and outputs a detection signal indicative of the deterioration, wherein the controller executes the toner replacing process based on the detection signal.

5. The image forming device according to claim 4, wherein the deterioration detector detects the deterioration based on fog of toner produced on the photosensitive member.

6. The image forming device according to claim 4, wherein the deterioration detector detects the deterioration based on a drive amount in which the developing member is driven.

7. The image forming device according to claim 4, wherein the controller executes an image forming process for a job to print an instructed number of pages, the controller executing the image forming process without executing the developer replacing process if the deterioration detector has detected the deterioration when number of pages in the job that have yet to undergo the image forming process is less than or equal to a prescribed number of pages.

8. The image forming device according to claim 4, wherein the controller executes an image forming process for a job to print an instructed number of pages, the controller executing the image forming process after executing the developer replacing process if the deterioration detector has detected the deterioration prior to performing the image forming process on,a first page of the instructed number of pages.

9. The image forming device according to claim 4, wherein the controller executes an image forming process to form full-color images using cyan, yellow and magenta toners, wherein the developing chamber, the accommodating chamber, the supply auger, and the discharge auger are provided separately for each of the cyan, yellow and magenta toners.

10. The image forming device according to claim 9, wherein the controller executes the developer replacing process for each of the cyan, yellow and magenta toners.

11. The image forming device according to claim 9, wherein the controller executes the image forming process to form the full-color images using black toner in addition to cyan, yellow and magenta toners, wherein the developing chamber, the accommodating chamber, the supply auger, and the discharge auger are provided separately for each of the cyan, yellow, magenta and black toners.

12. The image forming device according to claim 9, wherein the controller executes the developer replacing process for each of the cyan, yellow, magenta and black toners.

13. The image forming device according to claim 1, wherein the accommodating chamber has a larger toner accommodating capacity than the developing chamber.

14. The image forming device according to claim 1, wherein the accommodating chamber and the waste toner accommodating chamber are formed as a unit, the unit being detachably mounted in the image forming device.

15. The image forming device according to claim 1, further comprising a supply member that is housed in the developing chamber, supplies toner toward the developing member when the controller executes an image forming process, and supplies toner toward the discharge auger during the toner replacing process.

16. The image forming device according to claim 15, wherein the supply member is disposed substantially to a side of the discharge auger.

17. The image forming device according to claim 1, further comprising a shutter that is housed in the developing chamber and opens the discharge auger to or closes the discharge auger from the developing chamber.

18. The image forming device according to claim 1, wherein toner is positively charged.

19. The image forming device according to claim 1, wherein toner is made from a nonmagnetic single-component material.

* * * * *